US005975441A

United States Patent [19]

Burkholder

[11] Patent Number: 5,975,441

[45] Date of Patent: Nov. 2, 1999

[54] APPARATUS FOR SEPARATING ROCKS FROM SOIL

[76] Inventor: Melvin M. Burkholder, 2613 Stagecoach La., Lancaster, Pa. 17601

[21] Appl. No.: 09/213,226

[22] Filed: Dec. 17, 1998

Related U.S. Application Data

[60] Provisional application No. 60/068,994, Dec. 29, 1997.

[51] Int. Cl.[6] ..... B02C 4/08

[52] U.S. Cl. ..... 241/24.12; 241/24.23; 241/27; 241/79; 241/86; 241/101.76

[58] Field of Search ..... 241/76, 79, 86, 241/87, 24.12, 24.23, 101.76, 186.35, 159, 27, 236; 209/420, 421

[56] References Cited

U.S. PATENT DOCUMENTS

| | | | |
|---|---|---|---|
| 1,067,204 | 7/1913 | Vrooman | 209/421 X |
| 1,277,344 | 8/1918 | McCargar | 241/159 |
| 1,454,548 | 5/1923 | Lennon | 241/159 |
| 3,016,203 | 1/1962 | Sears et al. | 241/76 X |
| 3,704,834 | 12/1972 | Nilsson et al. | 241/79.2 |
| 3,802,640 | 4/1974 | Sievert | 241/101.7 |
| 3,929,294 | 12/1975 | Cox | 241/101.7 |
| 4,197,194 | 4/1980 | Read | 209/325 |
| 4,592,516 | 6/1986 | Tschantz | 241/76 |
| 4,891,099 | 1/1990 | Silveri | 241/78 |
| 4,955,756 | 9/1990 | Klamar | 209/421 X |
| 5,595,350 | 1/1997 | Massaro, Jr. et al. | 241/65 |

*Primary Examiner*—John M. Husar
*Attorney, Agent, or Firm*—Larry W. Miller

[57] ABSTRACT

An apparatus for separating stones from stone-laden earthen material, particularly material that has been previously discarded from stone quarries, includes a hopper having a conveyor that feeds quantities of stone-laden earthen material unto a bed of spiked rollers that separates the earthen material from the stones, allowing the earthen material to pass through interstitial spaces between the spikes on adjacent rollers and conveying the remaining stones to the discharge end of the bed. The detachably mounted spikes on adjacent spiked rollers are offset with respect to one another to permit the spikes on adjacent rollers to pass between each other as the rollers are rotated. The drive mechanism allows each respective spiked roller to be driven independently and at different rotational speeds relative to one another at least for short periods of interrupted operation. A collector conveyor is provided for each zone of the bed of spiked rollers that corresponds to a different type of separated material passing through the bed.

20 Claims, 13 Drawing Sheets

Fig. 12
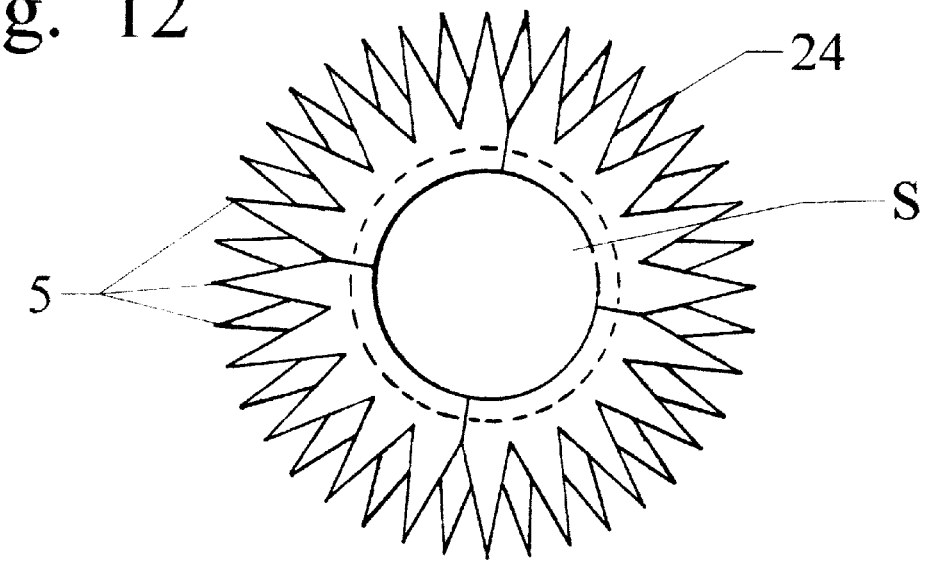
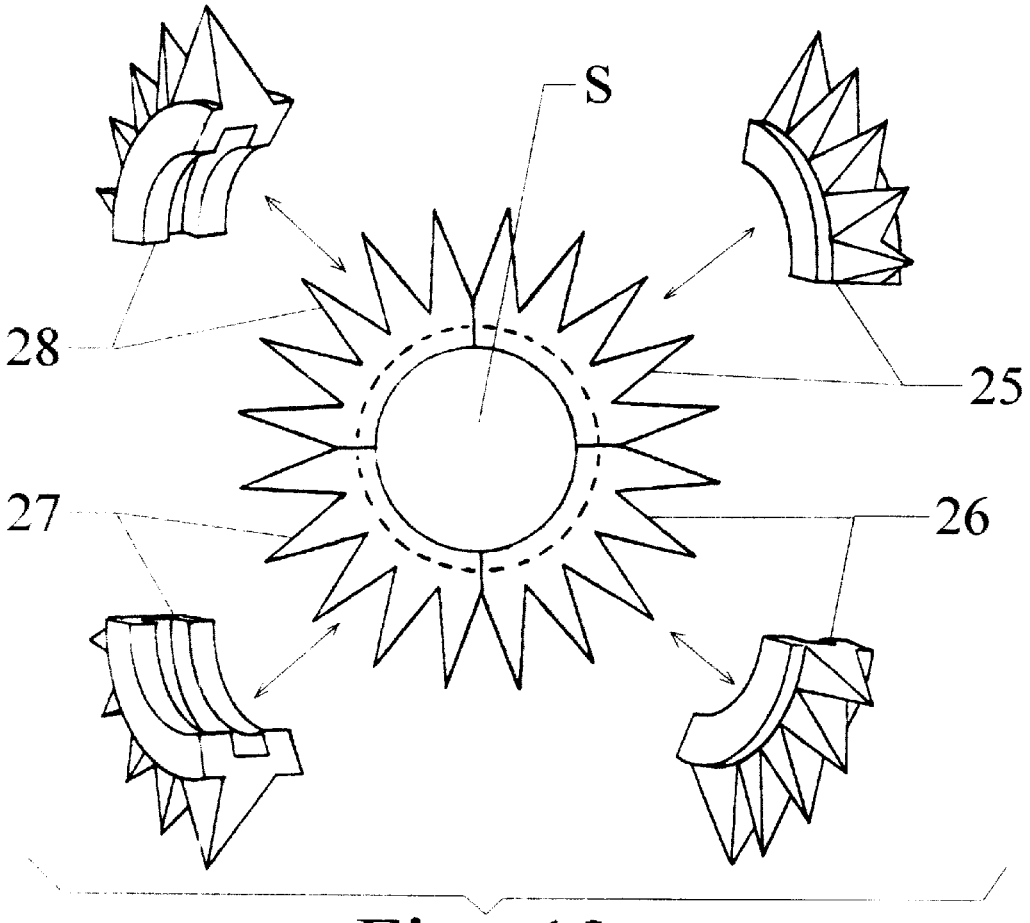
Fig. 13

APPARATUS FOR SEPARATING ROCKS FROM SOIL

This application claims the benefit of provisional application No. 60/018,994, filed Dec. 29, 1997.

BACKGROUND OF THE INVENTION

This invention relates generally to an apparatus for separating earthen material containing rocks or stones from soil and, more particularly, to a machine that can receive quantities of waste material from a quarry and extract the desired rocks or stones therefrom by separating out the clay, mud or dirt.

Quarries, such as limestone quarries and the like, produce a stone product in a variety of configurations. Such stone product can be utilized in a variety of known different ways, including concrete aggregate, asphalt paving aggregate, concrete blocks, etc. Stone aggregate is used as base material in concrete and asphalt paving, beneath footers and basement of buildings and many other similar known uses. Limestone, particularly when finely crushed, is used as a soil additive in agricultural applications and, if of a very high calcium content, can even be finely processed to be used in cosmetics.

Mining or quarry operations operate to extract the desired stone from the ground in a number of different manners, including boring and stripping. In a quarry, for example, a hole is dug into the ground to remove the soil and stone. Blasting is often utilized to loosen the rock and permit removal thereof. Loaders collect the rock and soil and trucks remove the material to a processing or crushing plant for further processing. In the blasting process, particularly, rock is typically discharged onto the quarry floor where it can become mixed with clay, mud and soil to contaminate the material.

Clay, mud and soil is also found naturally with the rock material when extracted from the ground. Unless the rock material can be adequately separated from the clay, mud and soil the material cannot be sent to the crushing plant as the finished product will be similarly contaminated. Accordingly, contaminates such as clay, mud and soil are unacceptable and substantial amounts thereof render material unusable.

Quarries have typically discarded materials that are deemed to be too heavily contaminated with clay, mud and soil. Generally, such contaminated materials are transported to a designated dump site and stockpiled as rubble. Occasionally, the largest of the rocks are picked from the discarded rubble with traditional equipment, such as a loader or a backhoe. Such activities are quite labor intensive and are not cost effective for the amount of recoverable material that can be gleaned from the operation. Some quarries have tried to utilize screening machines to sift through the discarded rubble, but such machines tend to plug or clog with the contaminates and are thereby rendered useless.

Accordingly, it would be highly desirable to provide an apparatus that could effectively and economically separate the contaminating clay, mud and soil from rocks found in the discarded rubble.

SUMMARY OF THE INVENTION

It is an object of this invention to overcome the aforementioned disadvantages of the prior art by providing an apparatus for separating stones from stone-laden earthen material having a bed of spiked rollers over which the earthen material is conveyed to separate the unwanted earthen material from the desired rocks and stones.

It is a feature of this invention that the contaminated, discarded rubble from quarry operations can be processed to recover usable stone material from such rubble.

It is an advantage of this invention that the recovery of usable stone material from contaminated, discarded rubble can be done economically.

It is another object of this invention to provide an apparatus that can economically and efficiently reclaim usable stones and other earthen material from discarded rubble from stone quarry operations.

It is another feature of this invention that the apparatus includes a bed of spiked rollers that separate earthen material from usable stone material which is conveyed over top of the rollers to a discharge end of the bed.

It is another advantage of this invention that the earthen material falls through interstitial spaces between spike members in the bed of spiked rollers where such material can be collected for removal to a remote location.

It is still another feature of this invention that the earthen material falling through the bed of spiked rollers is naturally segregated by different types of material falling through different zones of the bed.

It is still another advantage of this invention that the earthen material falling through the different zones of the bed of spiked rollers can be collected in generally segregated material types to facilitate further processing of the collected material.

It is still another object of this invention to pivotally mount the bed of spiked rollers on the apparatus frame so that the bed can be oriented at a selected attitude to control the rate of flow of the earthen material over the top of the bed of spiked rollers by manipulating the effects of gravity on the earthen material.

It is yet another object of this invention to provide a drive mechanism for the bed of spiked rollers that will allow each roller to be driven independently and at a different rate of speed for at least limited periods of interrupted operation.

It is yet another feature of this invention that the frame of the apparatus includes wheels that permit the apparatus to be moved easily from one location to another.

It is a further feature of this invention that the apparatus can be constructed as a stationary unit for on-site installation.

It is yet another advantage of this invention that the apparatus can be positioned next to a pile of discarded earthen material to minimize transportation of the discarded material to the apparatus for processing.

It is a further object of this invention to provide a method of separating stones from discarded rubble from a quarry operation that economically and efficiently reclaims usable earthen and stone materials from such discarded material.

It is yet another object of this invention to provide an apparatus for recovering stone material from discarded rubble from quarry operations which is durable in construction, inexpensive of manufacture, carefree of maintenance, facile in assemblage, and simple and effective in use.

These and other objects, features and advantages are accomplished according to the instant invention by providing an apparatus for separating stones from stone-laden earthen material, particularly material that has been previously discarded from stone quarries. The apparatus includes a hopper having a conveyor that feeds quantities of stone-laden earthen material unto a bed of spiked rollers that separates the earthen material from the stones, allowing the earthen material to pass through interstitial spaces between the spikes on adjacent rollers and conveying the remaining stones to the discharge end of the bed. The detachably mounted spikes on adjacent spiked rollers are offset with respect to one another to permit the spikes on adjacent rollers to pass between each other as the rollers are rotated. The drive mechanism allows each respective spiked roller to be driven independently and at different rotational speeds relative to one another at least for short periods of interrupted operation. A collector conveyor is provided for each zone of the bed of spiked rollers that corresponds to a different type of separated material passing through the bed.

BRIEF DESCRIPTION OF THE DRAWINGS

The advantages of this invention will be apparent upon consideration of the following detailed disclosure of the invention, especially when taken in conjunction with the accompanying drawings wherein:

FIG. 12 is an end view of one of the spiked roller assemblies depicting the offset nature of the spikes mounted onto the roller shaft along the length of the shaft;

FIG. 13 is an exploded end view of one of the spiked roller assemblies with a set of the spiked segments being depicted in perspective exploded away from the roller shaft;

DETAILED DESCRIPTION OF THE PREFERRED EMBODIMENT

Figure 1:
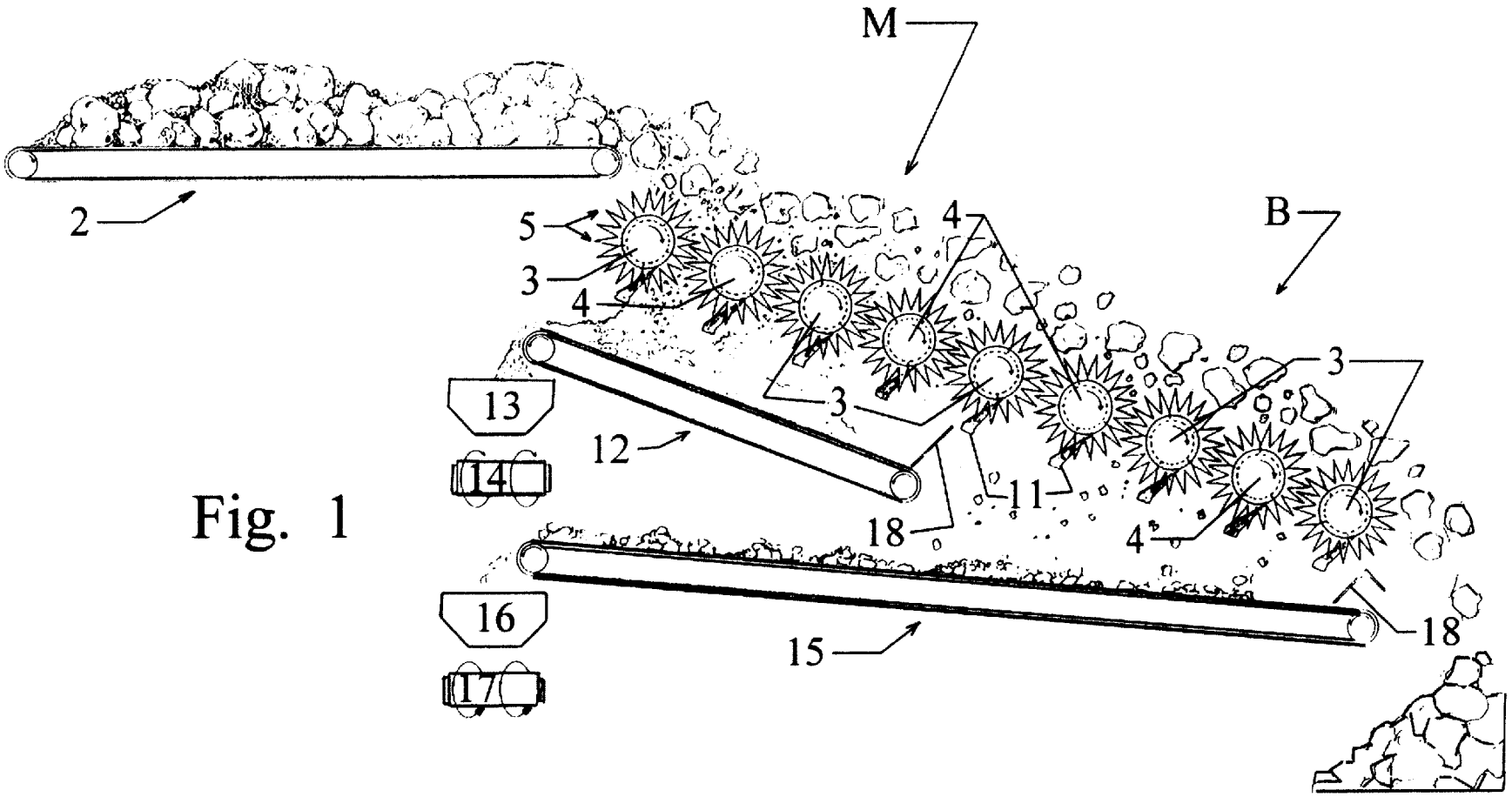
FIG. 1 is a schematic side elevational, cut-away view of the apparatus incorporating the principles of the instant invention, the operation thereof being diagrammatically depicted.
Figure 2:
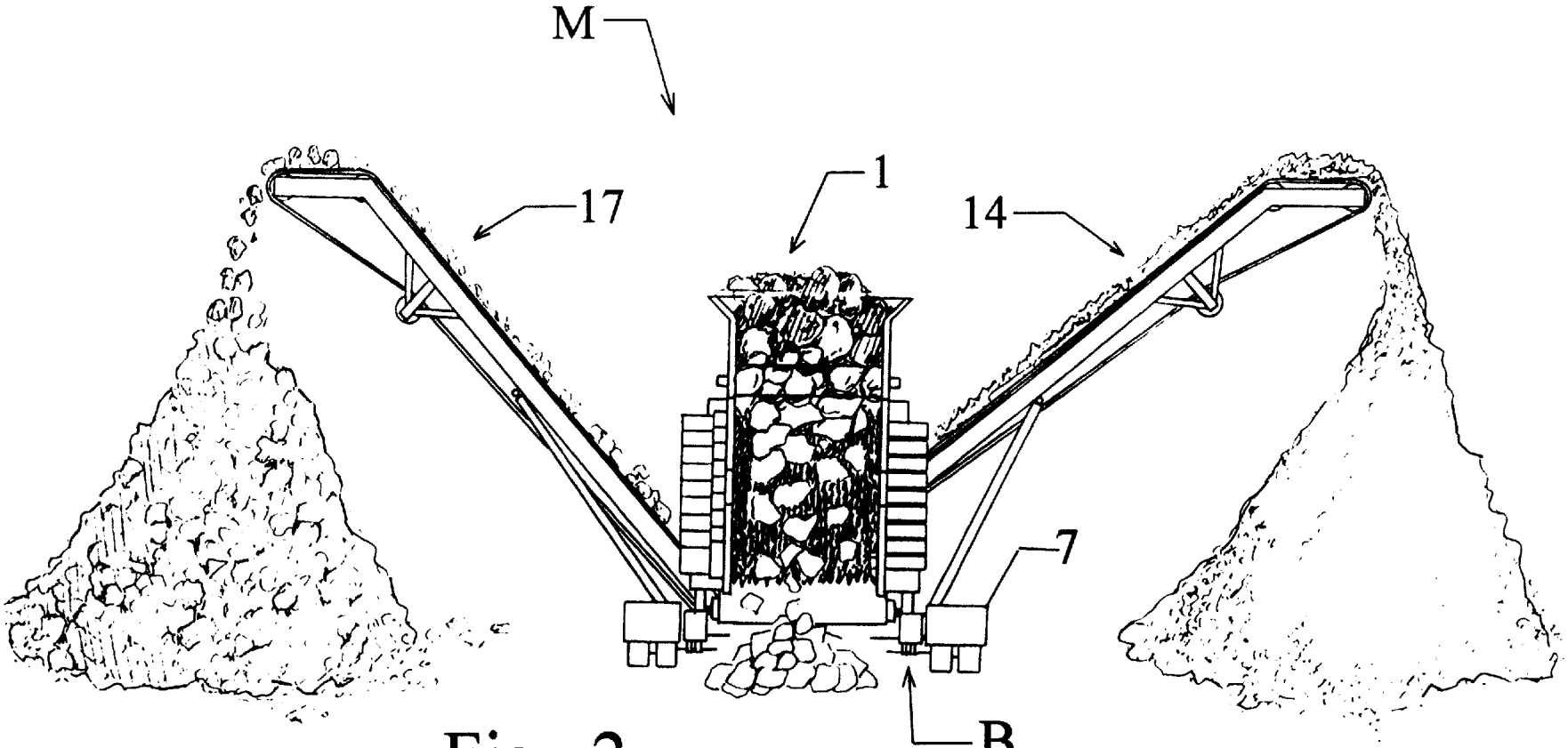
FIG. 2 is a rear elevational view of the apparatus depicted in FIG. 1, the operation thereof being depicted as separating the discarded rubble or contaminated material into three parts, soil material, smaller sized stone and larger sized stone, the apparatus being depicted as being mounted on a trailer to provide portability.

Referring first to FIGS. 1–7, the general description of the rock separator machine M incorporating the principles of the instant invention can best be seen. Preferably, the machine M will be mounted on a trailer 7 to provide portability for the machine M. Any left and right references are used as a matter of convenience and are determined by standing at the rear discharge end of the machine and facing the hopper end of the machine. In conjunction with the apparatus M shown and described in the drawings, a method of separating rock from clay, mud and soil and segregating the respective components is also shown and described herein. Accordingly, a method and apparatus for decontaminating rock material is shown and described.

The machine M includes a frame F upon which is supported an elevated hopper 1 operable to receive supplies of contaminated rock material delivered thereto by an extraneous mechanism, such as a loader or a conveyor (not shown). A feeder conveyor 2 cooperates with the hopper 1 to meter the contaminated material from the hopper and allow the material to be slowly transported onto the spiked roller assembly bed B.

The spiked roller assembly bed B is formed from a plurality of longitudinally spaced, parallel spiked rollers 3, 4, operably powered for rotation in the same direction to convey the material received from the feeder conveyor 2 to the discharge end of the bed B at the rear of the machine M. The details of the spiked roller assemblies 3, 4 are described below; however, alternating roller assemblies 3, 4 have the spike members 5 transversely spaced to allow the spike members 5 of one roller assembly 3 to pass upon rotation through the interstitial gaps 6 between the spike members 5 of the adjacent roller assembly 4. In this manner, the spiked roller assembly bed B presents a live surface over which the contaminated material from the feeder conveyor 2 can traverse, yet provide sufficient space between the spike members 5 for contaminates separated from the material to pass below the bed B.

During the operation of the spiked roller assembly bed B, the jarring of the rocks within the contaminated material discharged from the feeder conveyor 2 by the rotating spike members 5 knocks the clay, mud and soil off the rocks rather quickly to enable most of this contaminate to pass between the spike members 5 near the forward end of the bed B. This material is collected by a first conveyor system 12–14 and transported to a remote location, such as to the right of the machine M where it can be collected and transported as desired.

The action of the rotating spike members 5 serves to break up some of the stones and rocks within the contaminated material. Once separated from the clay, mud and soil contaminates, the smaller rocks and broken pieces of the larger rocks will be able to pass between the spike members 5 toward the discharge end of the bed B, whereupon they will be collected by a second conveyor system 15–17 to be transported to a remote location, such as to the left of the machine M. Meanwhile, the cleaned larger rocks, freed from the clay, mud and soil contaminates, will ultimately be conveyed along the spiked roller assembly bed B to the discharge end at the rear of the machine M where the cleaned rock can be collected and taken to the crushing machine (not shown) for further processing.

Figure 3:
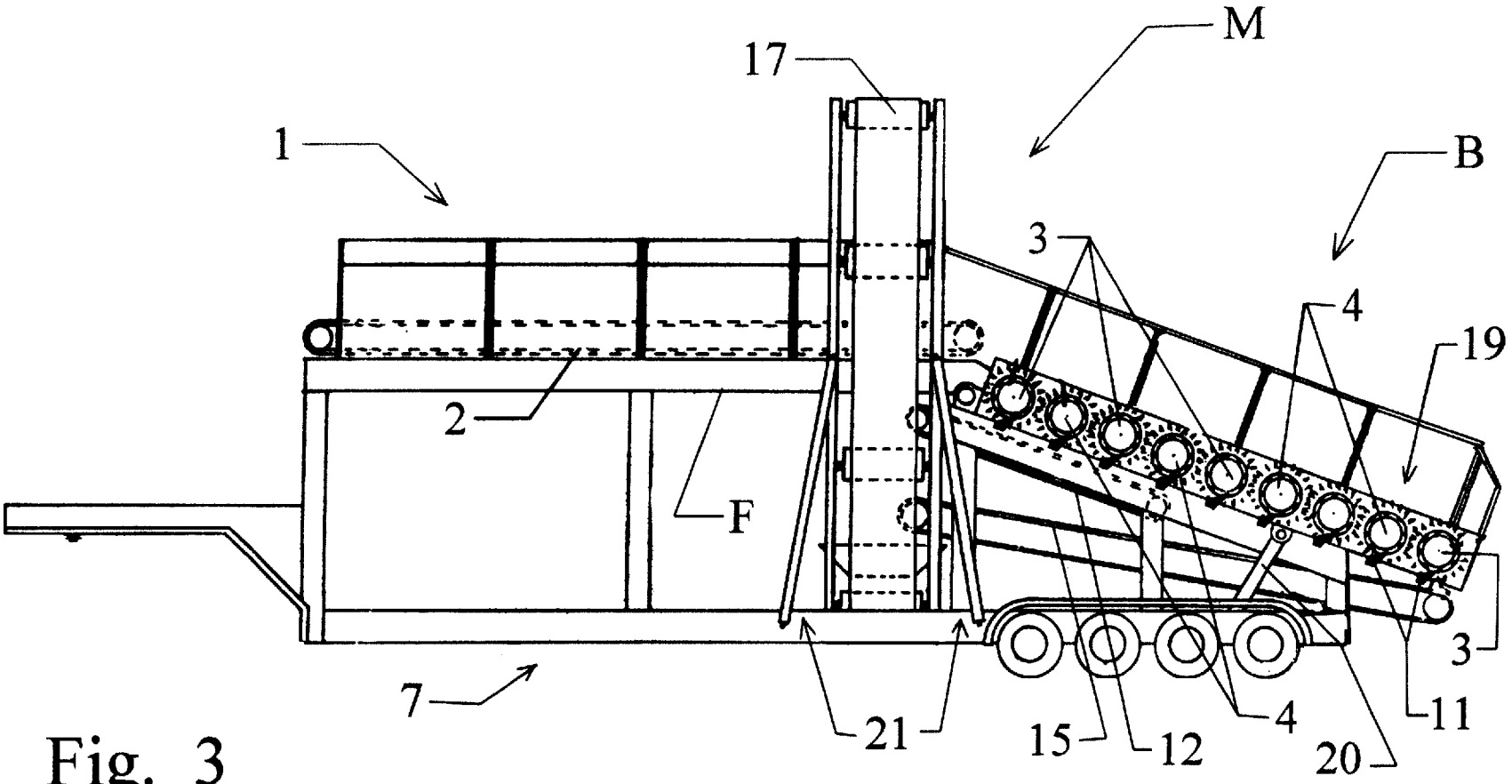
FIG. 3 is a left side elevational view of the apparatus shown in FIG. 2.
Figure 4:
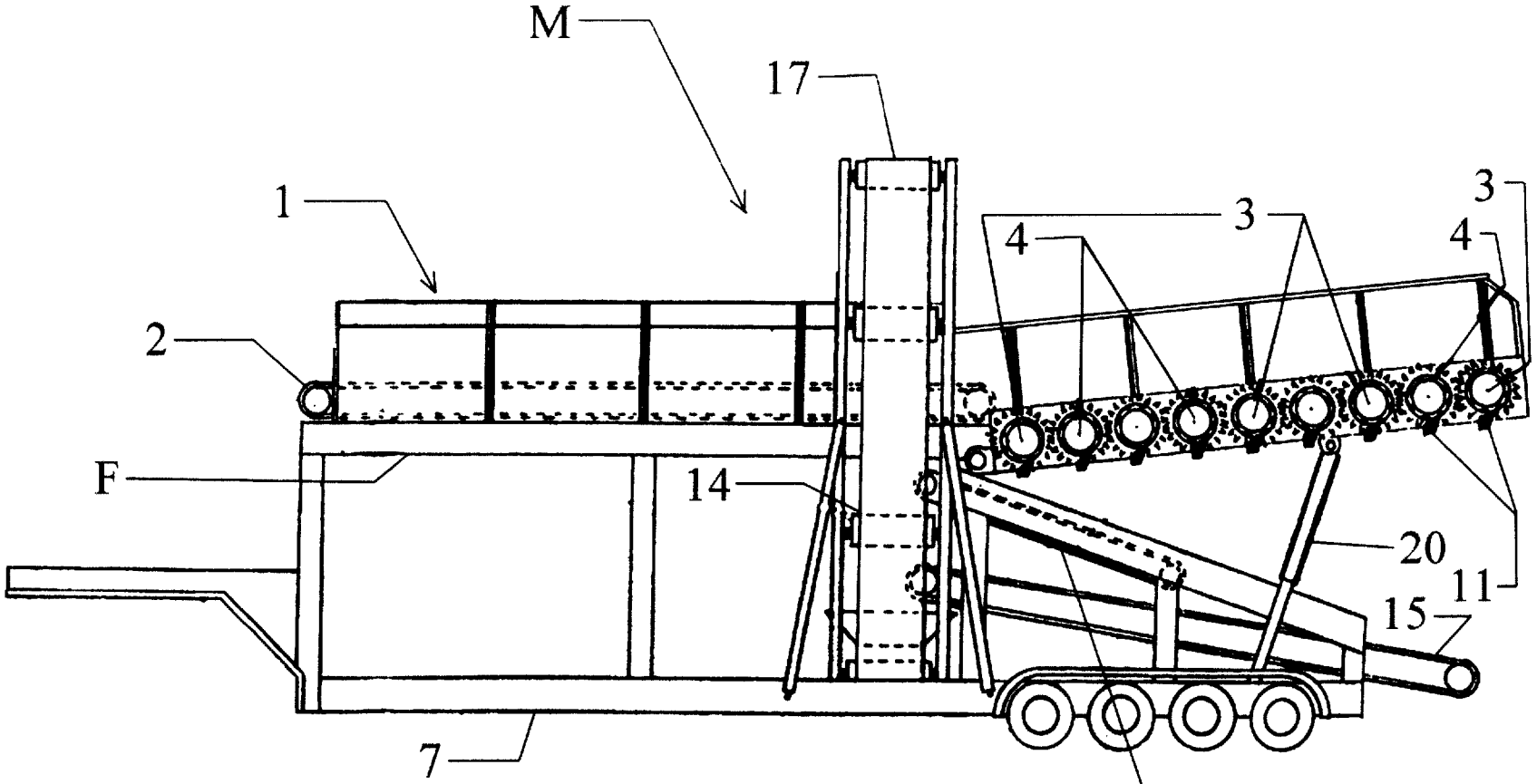
FIG. 4 is a left side elevational view of the apparatus as shown in FIG. 3, except that the spiked roller assembly bed has been oriented into a pivotally elevated position to retain the material on the assembly for a longer period of time.
Figure 5:
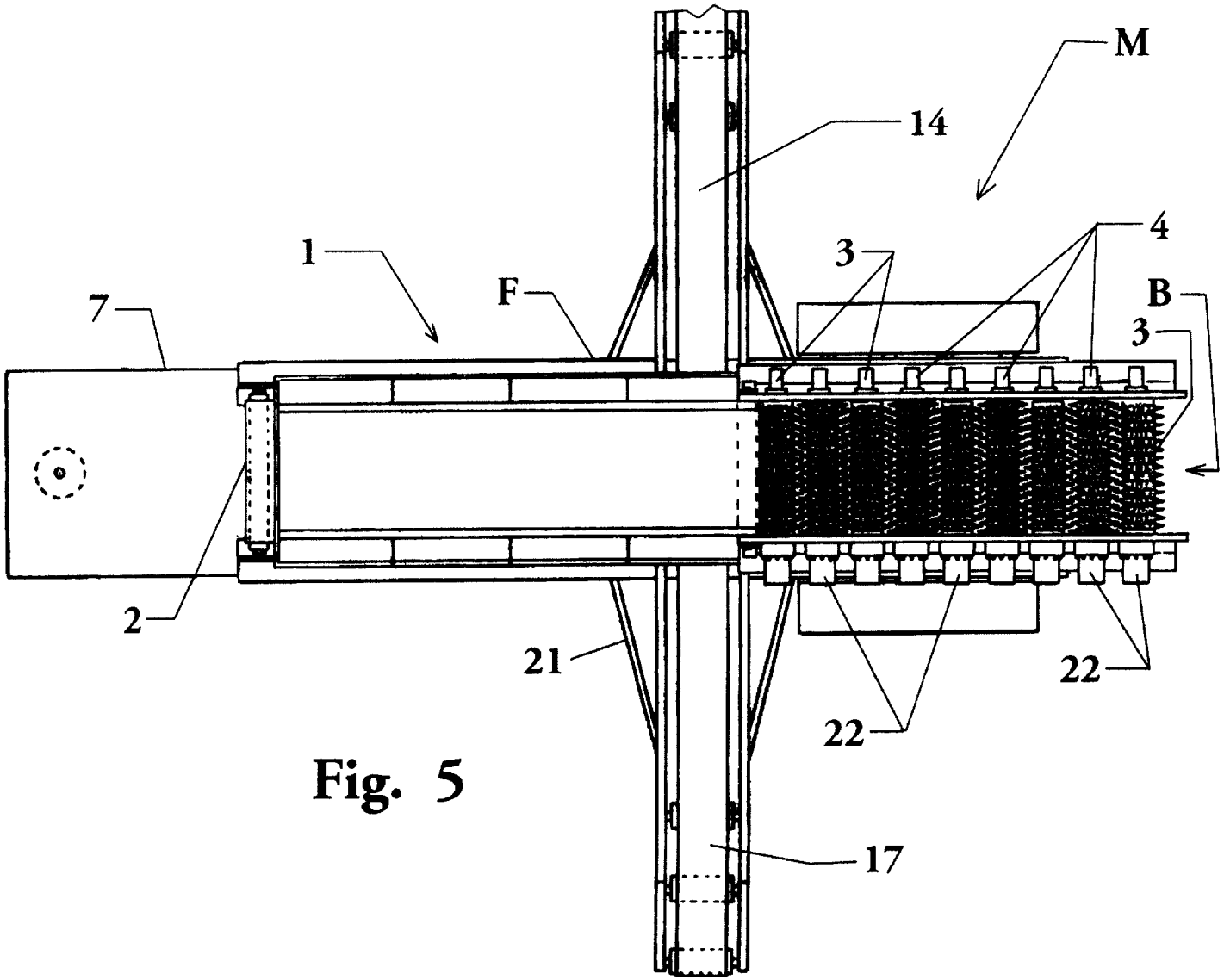
FIG. 5 is a top plan view of the apparatus shown in FIG. 3.
Figure 6:
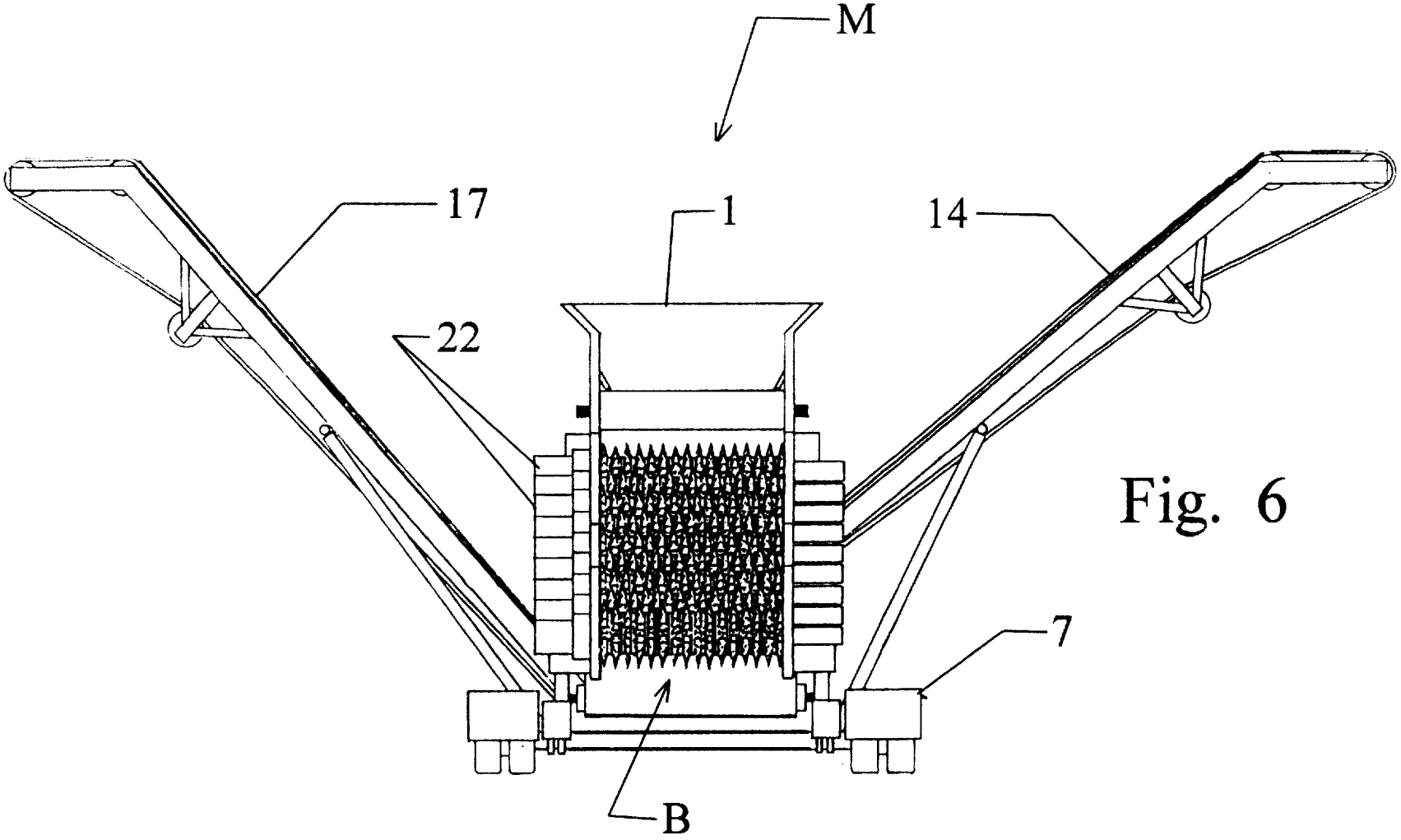
FIG. 6 is a rear elevational view of the apparatus shown in FIG. 3.
Figure 7:
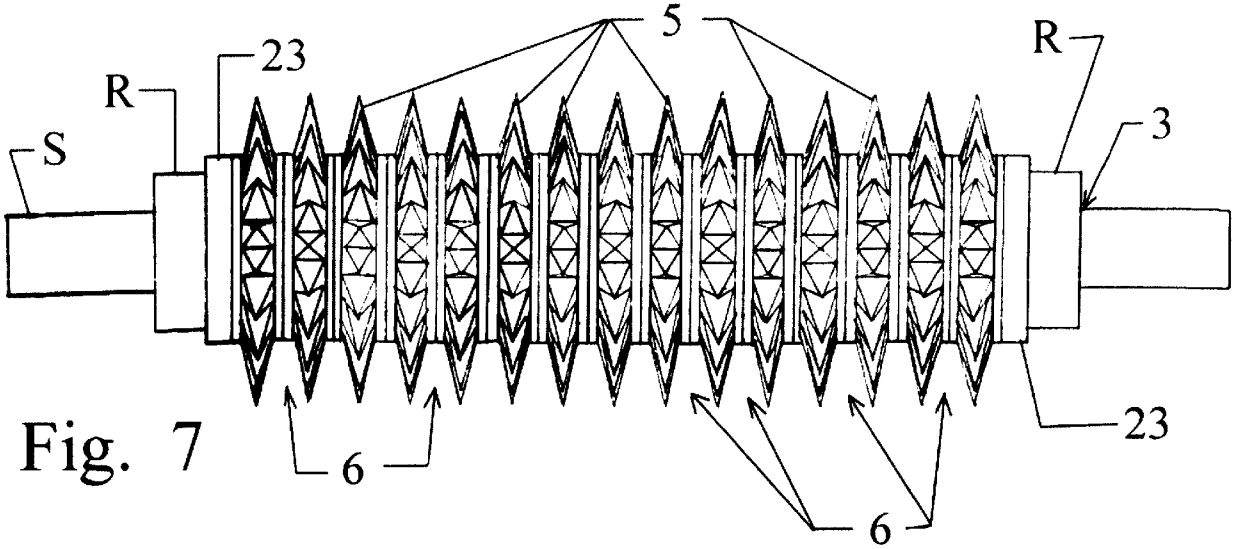
FIG. 7 is an elevational view of one of the "A" spiked rollers.

As best seen in FIGS. 3 and 4, the spiked roller assembly bed B is preferably pivotally supported from the frame F of the machine M such that the rear discharge end of the bed B can be raised and lowered to control the flow of material over the bed B. The pivotal mounting of the frame F is considered to be optional to the operation of the machine M in that the pivotal movement of the bed B as described in greater detail below may enhance the operation of the machine M. A pair of transversely opposed hydraulic cylinders 20 operatively associated with a conventional hydraulic system (not shown) power the pivotal movement of the bed B. When the bed B is in the lowered position, as depicted in FIG. 3, gravity assists the flow of material, particularly the cleaned rocks, over the live surface of the bed B.

Raising the bed B to the fully elevated position shown in FIG. 4, eliminates the gravity factor in the conveyance of material over the live surface of the bed B and, therefore, slows down the movement of material to the discharge end of the bed B. Since the spiked roller assemblies 3, 4 are rotating in a direction to move the material toward the discharge end of the bed B, the material will eventually be conveyed to the discharge end, but at a slower rate. As a result, the more severely contaminated the material is with clay, mud or soil, the operator will pivotally raise the bed B accordingly so that only cleaned rock will be discharged off the end of the bed B.

The spiked roller assembly bed B is also constructed with opposing side sheets 19 that project upwardly above the live surface of the bed B to contain the material being conveyed along the live surface of the bed B. With the spiked roller assemblies 3, 4 being rotated as speeds of preferably about 30 to 60 RPM, the hard rocks tend to bounce substantially on top of the hardened spike members 5, requiring the use of the side sheets 19 to serve as shields that restrain the bouncing rocks on the live surface of the bed B.

The spiked roller assemblies 3, 4 are preferably individually rotatably powered by separate hydraulic motors 22 operably connected to a conventional hydraulic system (not shown). A conventional engine (not shown), or other conventional means of providing operative power, can be supported on the frame F of the machine M to drive the feeder conveyor 2, the first and second conveyor systems 12, 14, 15, 17, and the hydraulic system providing hydraulic power for the hydraulic cylinders 20 and the hydraulic motors 22.

Figure 8:
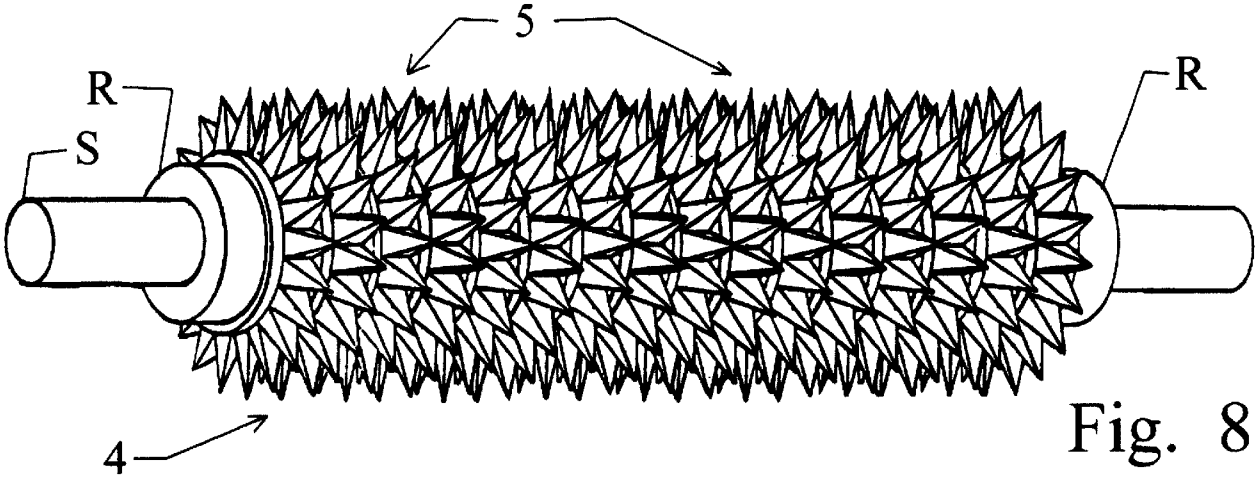
FIG. 8 is a perspective view of one of the "B" spiked rollers.
Figure 9:
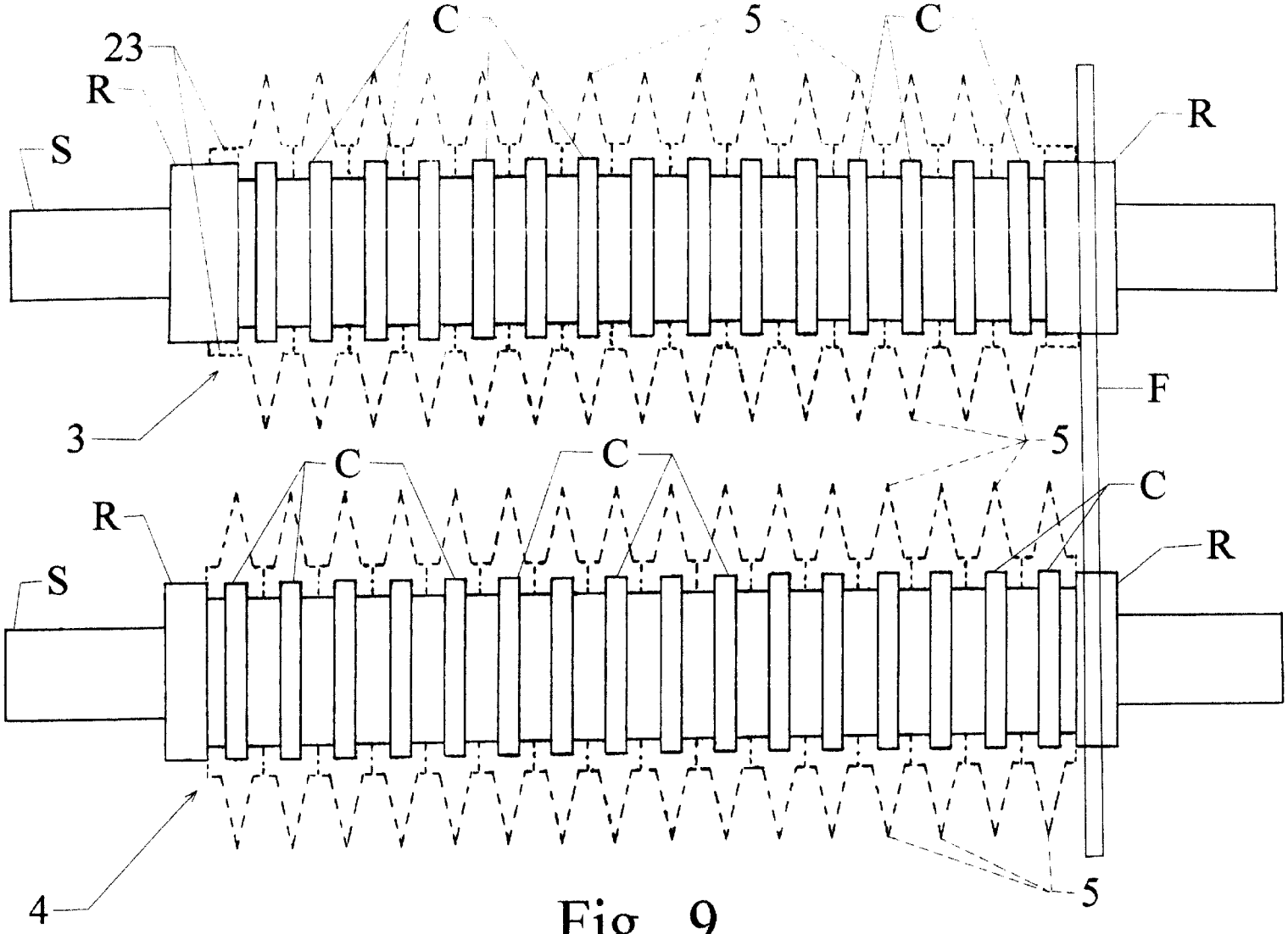
FIG. 9 is plan view of the adjacent "A" and "B" roller shafts spaced apart somewhat to better view the details of the roller shafts, the spikes being shown in phantom.
Figure 10:
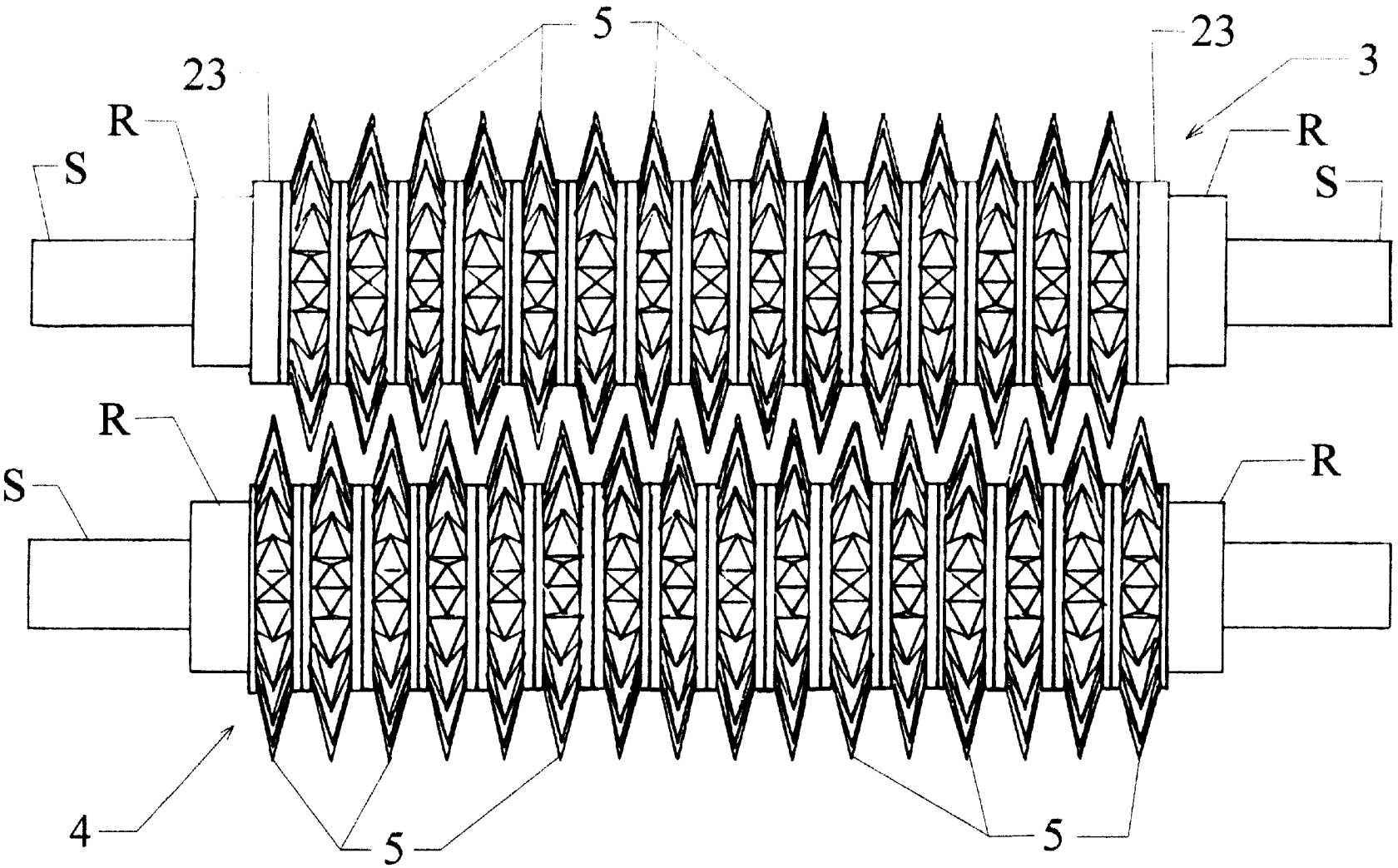
FIG. 10 is a plan view of the adjacent "A" and "B" spiked roller assemblies, depicting the spatial relationship between the spike members of the "A" and "B" rollers.
Figure 11:
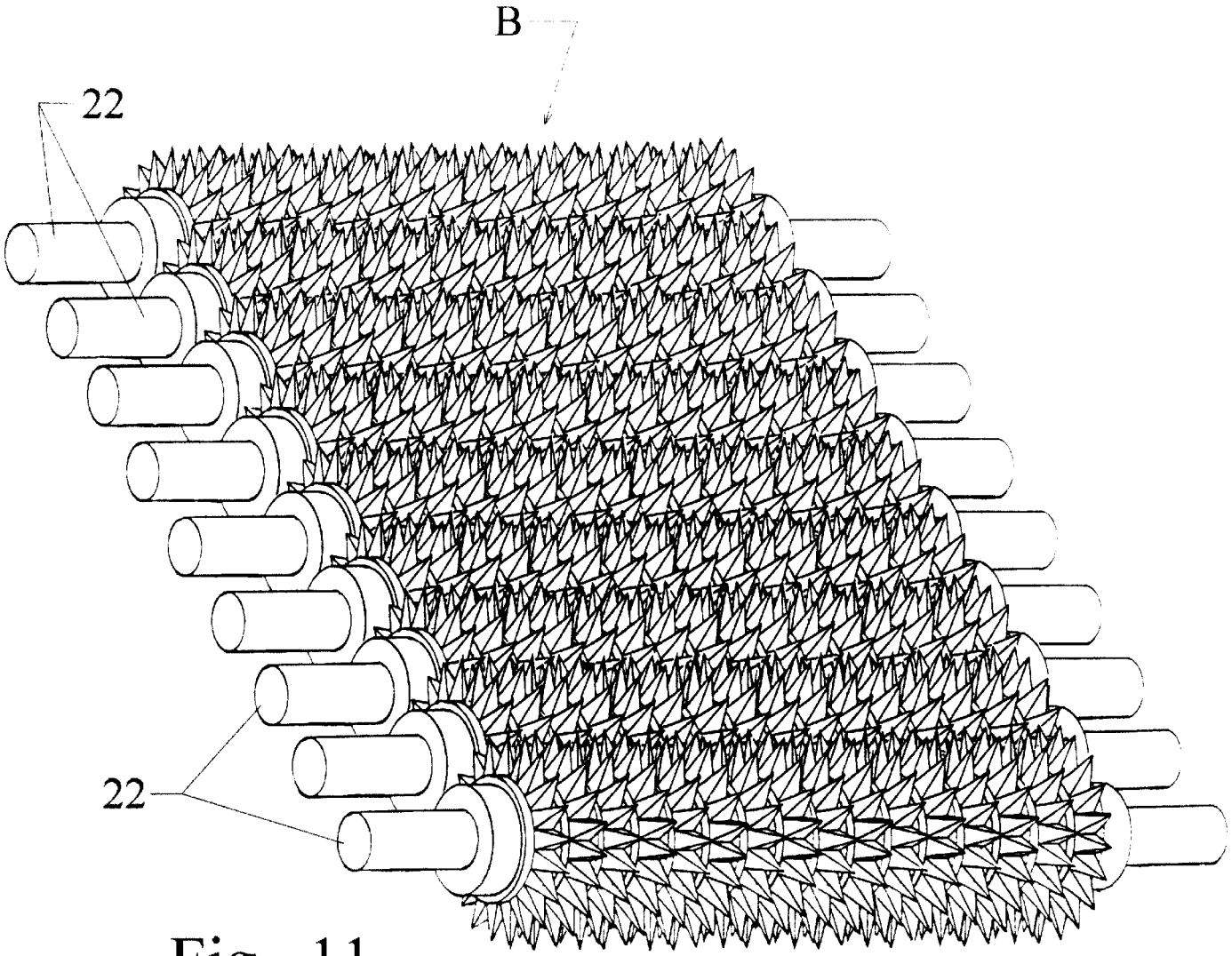
FIG. 11 is a perspective view of the spiked roller assembly bed depicting the relationship of the respective roller assemblies.
Figure 14:
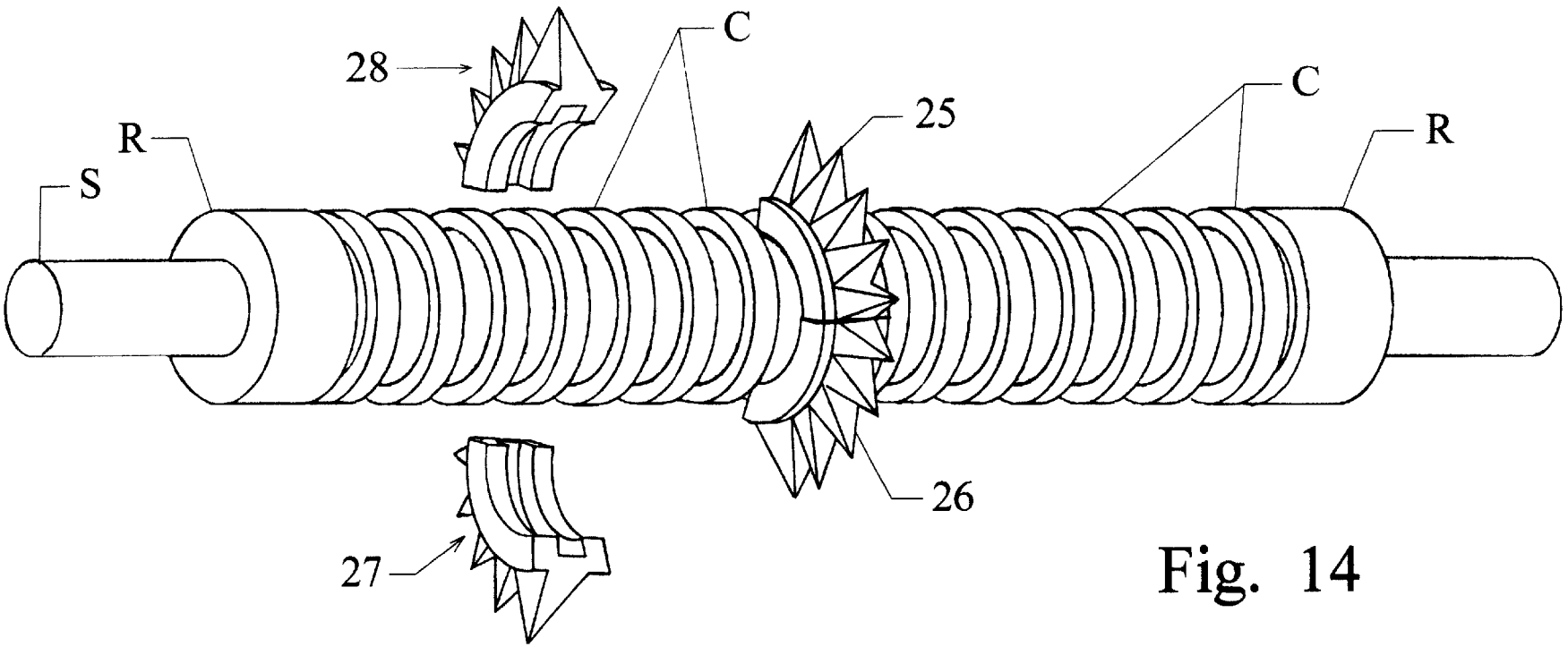
FIG. 14 is a perspective view of one of the "A" roller assembly shafts with a set of spiked segments being representatively shown, two of which are exploded away from the shaft.
Figure 15:
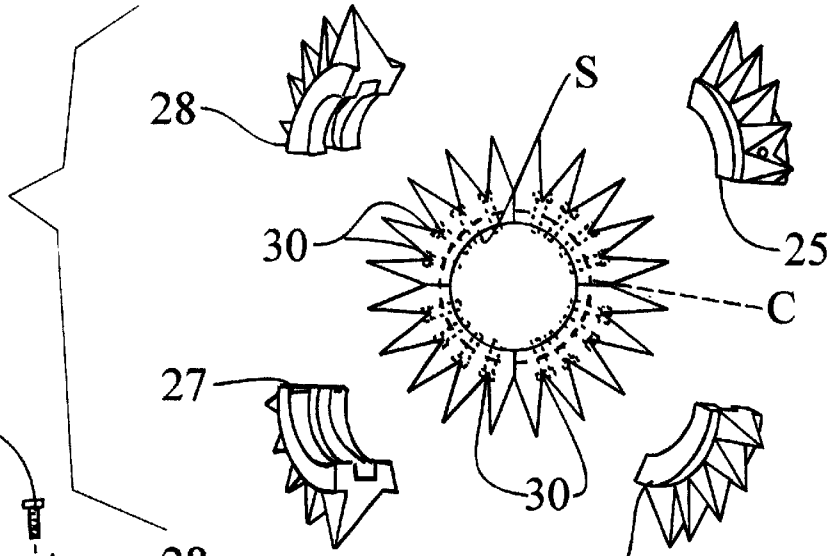
FIG. 15 is an exploded end view of one of the spiked roller assemblies similar to FIG. 13, but with bolts fastening the spiked segments to the roller shaft being shown in phantom.
Figure 16:
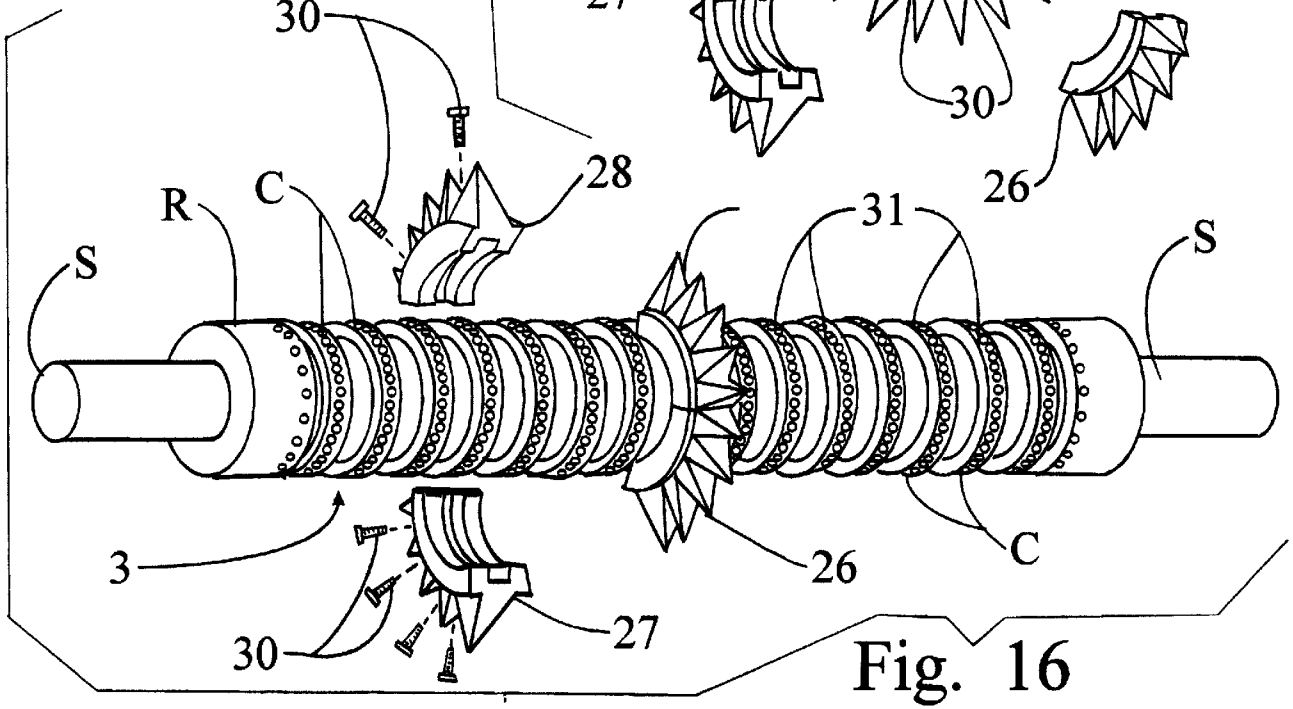
FIG. 16 is a perspective view of one of the "A" roller assembly shafts similar to FIG. 15, but with a set of spiked segments being representatively shown, two of these spiked segments and the corresponding mounting bolts being exploded away from the shaft.

Referring now to FIGS. 7–16, the details of the spiked roller assemblies 3, 4 can best be seen. Each roller assembly 3, 4 includes a shaft member S having formed thereon, or integrally affixed thereto, a plurality of transversely spaced mounting collars C upon which the spike member segments or quadrants 25, 26, 27, 28 are to be mounted, as will be described below. Each roller shaft S is provided with first and last restraining collars R that serve to restrain the first and last sets of spike segments 25, 26, 27, 28 on the assembly 3, 4. On the "A" roller 3, the restraining collars R are transversely wider than their counterparts on the "B" roller 4. This extra width is equal to one half of the transverse width of the spike segments 25, 26, 27, 28 in order to offset the relative transverse spacing of the adjacent roller assemblies 3, 4, as is best seen in FIGS. 9 and 10.

Each row of spike members 5 is preferably formed or cast as four quadrant segments 25, 26, 27, 28 having a channel formed in the bottom thereof to receive the mounting collar C so that the quadrant segment 25, 26, 27, 28 can be detachably fastened to the mounting collars C, preferably by threaded fasteners 30. Each spike member segment 25, 26, 27, 28 has a plurality of hardened spike members 5 projecting outwardly therefrom and when each of the four quadrant segments 25, 26, 27, 28 are mounted on the corresponding collar C, a continuous ring of spike members 5 encircle the shaft S. Although four fasteners 30 are depicted as being preferable for mounting the spiked segments on the roller shaft S, due to the harsh operative environment, one skilled in the art will recognize alternative mounting arrangements and configurations for detachably mounting the spiked segments 25, 26, 27, 28.

As is best seen in FIGS. 8 and 12, transversely adjacent rows or rings of spike members 5 are offset one half of a tooth spacing so that a staggered spike member 5 spacing is obtained along the transverse width of each of the roller assemblies 3, 4. On the opposed transverse ends of the "A" roller assembly 3, a wear member 23 is mounted to the restraining collars R so that the overall transverse width of the roller assembly is the same as the "B" roller 4. As schematically depicted on FIGS. 15 and 16, the mounting collars C are preferably provided with a sufficient number of threaded openings 31 to accommodate the mounting of the spiked segments 25, 26, 27, 28 in each of the mounted positions.

In operation, the machine M will separate clay, mud and soil contaminates from discarded contaminated material (or from any such contaminated material) placed into the hopper 1, such as by a loader (not shown). Since the machine M is portable, due to the mounting thereof on the trailer 7, the machine M can be moved to the bottom of the quarry floor right beside the contaminated material to be cleaned. A loader will then place quantities of the contaminated material into the hopper 1. The feeder conveyor 2 moves beneath the hopper 1 and transports the contaminated material from the hopper 1 to the spiked roller assembly bed B, the spacing between the bottom of the hopper 1 and the feeder conveyor 2 serving to meter the flow of material onto the bed B.

Accordingly, the feeder conveyor 2 slowly feeds the contaminated material onto the spiked roller assembly bed B. The rotating roller assemblies 3, 4 jar the rocks within the contaminated material and cause the clay, mud and soil contaminates to separate from the rocks. Most of these contaminates separate quickly and fall between the adjacent roller assemblies 3, 4 over the first three or four rollers 3, 4. This contaminate material is collected by the first collector conveyor 12 that transports the material forwardly away from the flow of the cleaned rocks on the live surface of the bed B. The first conveyor system 12 discharges the collected contaminates into a bin 13 that funnels this material onto a first transport conveyor 14, which is supported from the frame F by struts 21 and which removes this material to a remote location away from the machine M.

As the rocks continue along the live, rotating surface of the spiked roller assembly bed B, they are constantly cleaned as they are tumbled by the rotating spiked roller assemblies 3, 4 until discharged off the end of the bed B. In extremely contaminated conditions, the spiked roller assembly bed B can be elevated by an extension of the hydraulic cylinders 20 to slow the movement of the material along the surface of the bed B toward the discharge end thereof. Scrapers 11 are positioned between each ringed set of spike members 5 on each of the roller assemblies 3, 4 to clean the rollers 3, 4 and deliver the material to the conveyors 12, 15 positioned immediately below the bed B. A deflector 18 can be provided between the first and second conveyor systems 12, 15, or at the rearward end of the second collector conveyor 15 to keep the collected materials segregated.

The latter roller assemblies 3, 4 closer to the discharge end of the bed B, allow smaller stones and broken pieces of the larger stones to pass through the surface of the bed. Again scrapers 11 assist in discharging this material to the awaiting second collecting conveyor 15 below which transports the collected material forwardly away from the cleaned stone. This material consists mostly of crushed stones and rocks with a very slight amount of mud or soil that may not have passed through the first three or four rollers and fallen onto the first collector conveyor 12. The second collector conveyor 15 also discharges into a bin 16 that funnels the material onto a second transport conveyor 17, which is also supported from the frame F by struts 21 and which conveys the material to a remote location preferably on the opposite side of the machine M from the first transport conveyor 14.

The drive mechanism for the roller assemblies 3, 4 are preferably hydraulic in order to best allow the independent driving of each respective roller assembly 3, 4. In operation, stones or broken pieces of rock can become lodged briefly between any two adjacent roller assemblies 3, 4, causing the rotation of the roller assemblies 3, 4 to halt until the pressure breaks the stone or rock or it is otherwise popped out from between the rollers assemblies 3, 4. Accordingly, the rotation of any one roller assembly 3, 4 must be capable of being interrupted relative to its adjacent roller assembly 3, 4. Furthermore, the rotational power should preferably continue to be exerted on the roller assemblies 3, 4 even when temporarily jammed. A hydraulic drive mechanism 22 would be ideal for such an operation as the increases in hydraulic pressure resulting from a temporary jamming of adjacent roller assemblies 3, 4 can be vented over relief.

An alternative drive mechanism could be devised in the form of a chain or belt drive (not shown) in which each of the roller assemblies 3, 4 would be provided with a torque limiter, such as a clutch (not shown), to prevent damage to the drive mechanism to the jammed roller assemblies 3, 4, as well as the remaining roller assemblies 3, 4 which are interlinked with the jammed roller assemblies 3, 4 through the chain or belt drive mechanism. Accordingly, the drive mechanism must be capable of allowing the respective roller assemblies 3, 4 to be driven independently and at different speeds of rotation, for at least brief periods of interrupted operation.

The collected clay, mud and soil contaminate material is a saleable commodity that can be used as fill. Once separated from the rock, clay, mud and soil are not contaminates. The crushed stone and rocks collected by the second collector conveyor 15 is very useful as collected as a stone base for roads, parking lots, driveways, etc. Accordingly, the machine M receives contaminated quarry material and separates it into three useable and saleable products with little or no wasted by-products.

The instant invention provides a method and apparatus for taking contaminated quarry material and processing such material for separation thereof into useable and saleable components. The need for large and expensive equipment requiring a labor intensive operation to pick some of the largest rocks out of the contaminated material is eliminated. Furthermore, the need to transport the contaminated material away from the quarry for disposition into a discard pile of rubble is also eliminated. A quarry operation can process existing discarded material and convert it into profitably saleable material.

One skilled in the art will recognize that the number of spiked roller assemblies 3, 4 in the bed B would be dependent upon the severity of contamination of the material to be processed. While the preferred embodiment would have nine such roller assemblies 3, 4, other models could be provided with more or less roller assemblies 3, 4 to increase or to decrease, as desired depending on the severity of the contamination of the material being processed, the length of time the material is on the roller assembly bed B for processing thereof. Furthermore, the longitudinal spacing of the roller assemblies 3, 4 can be varied or can be made to be variable on the bed B with a simple bayonet-type slotted apertures for support of the roller shafts S. Varying the spacing between the roller assemblies 3, 4 will vary accordingly the amount of material passing between the roller assemblies 3, 4, particularly the amount of material received by the second collector conveyor 15. Also, the number of spike members 5 on each segment can be varied according to the application and the material to be processed.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. An apparatus for separating stones from earthen material comprising:

a frame;

a bed of spiked rollers rotatably mounted on said frame and including a plurality of co-rotated spiked rollers, each said spiked roller being oriented transversely to a flow of stone-laden earthen material passing over said spiked rollers and having a plurality of spikes extending circumferentially therefrom, each pair of adjacent rollers having said spikes in an offset relationship such that said spikes on adjacent rollers pass between the opposing spikes during rotation of said rollers to allow earthen material to pass between said spiked rollers while keeping stones above said spiked rollers, said rollers being oriented a descending elevational relationship to urge the stone-laden earthen material along a flow path over said rollers toward a discharge end of said frame where said stones are discharged from said apparatus; and drive means for co-rotating said rollers, each said roller being mounted for rotation independently of each other said roller.

2. The apparatus of claim 1 further comprising scrapers supported on said frame to engage said spiked rollers between said spikes to clean earthen material from said spiked rollers.

3. The apparatus of claim 2 further comprising a hopper for receiving quantities of stone-laden earthen material, said hopper includes a conveyor operable to move earthen material onto said bed of spiked rollers, said drive means being associated with said conveyor to power the operation thereof.

4. The apparatus of claim 2 further comprising a mechanism for receiving materials separated from said earthen material positioned below said bed of spiked rollers.

5. The apparatus of claim 4 wherein said mechanism for receiving materials includes at least one collector conveyor positioned beneath said bed of spiked rollers to receive separated materials pass through said bed of spiked rollers, said at least one collector conveyer transporting said separated materials to a remote location away from said bed of spiked rollers.

6. The apparatus of claim 5 wherein said mechanism for receiving materials includes a first collector conveyor for receiving separated materials passing through a first zone of said bed of spiked rollers and a second collector conveyor for receiving separated materials passing through a second zone of said bed of spiked rollers, said first and second collector conveyors transporting said separated materials to different remote locations.

7. The apparatus of claim 4 wherein said bed of spiked rollers is divided into a plurality of zones, said mechanism for receiving materials separated from said earthen material including a collector conveyor positioned beneath said bed of spiked rollers for each said zone, each said collector conveyor transporting separated materials to a location remote from said bed of spiked rollers.

8. The apparatus of claim 2 wherein said frame includes ground engaging wheels to permit said frame to be mobilely transported from one site to another.

9. The apparatus of claim 2 wherein said drive mechanism includes:

a hydraulic motor operably connected to each said roller; and a hydraulic system supplying hydraulic fluid under pressure to said hydraulic motors for powering the rotation of said rollers in an independent manner.

10. The apparatus of claim 2 wherein said drive mechanism includes:

a chain drive mechanism interlinking each said roller; and a torque limiter associated with each respective roller to permit the corresponding said roller to be driven independently and at different speeds of rotation than any adjacent said roller for at least brief periods of interrupted operation.

11. The apparatus of claim 2 wherein said spikes are formed of hardened metallic material configured in a pyramidal configuration with interstitial gaps between adjacent and opposing spikes, said separated material passing through said interstitial gaps.

12. The apparatus of claim 11 wherein each said spike is detachably connected to the corresponding roller.

13. The apparatus of claim 2 wherein said bed of spiked rollers is pivotally mounted on said flame such that said discharge end is generally vertically movable relative to said hopper to vary the descending relationship of said rollers.

14. A method of separating stone from stone-laden earthen material comprising the of steps of:

placing a quality of said stone-laden earthen material on a bed of spiked rollers having spikes extending circumferentially therefrom, each pair of adjacent rollers having said spikes in an offset relationship such that said spikes on adjacent rollers pass between the opposing spikes during rotation of said rollers, said spikes being oriented to form interstitial gaps therebetween for the passage of earthen material separated from stones between said rollers while said stones having a size larger than said interstitial gaps are maintained on top of said bed of spiked rollers;

co-rotating said spiked rollers by a drive mechanism permitting each said roller to be driven independently of and at different speeds of rotation relative to each said adjacent spiked roller for at least brief periods of interrupted operation to impart a tumbling motion to said stones on top of said bed of spiked rollers to dislodge earthen material therefrom and to convey said stones toward a discharge end;

separating earthen material from said stones by passing said earthen material through said interstitial gaps below said bed of spiked rollers; and discharging said stones from said discharge end of said bed of spiked rollers.

15. The method of claim 14 further comprising the step of:

scraping said spiked rollers to remove earthen material from said interstitial gaps between said spikes.

16. The method of claim 15 wherein said co-rotating and separating steps effect a separation of material through said bed of spiked rollers in zones corresponding to different types of material separated from said stone-laden earthen material.

17. The method of claim 16 further comprising the step of:

collecting said separated material passing through said bed of spiked rollers by a collecting conveyor corresponding to each said zone.

18. The method of claim 17 further comprising the step of:

vertically moving said discharge end of said bed of spiked rollers to vary a descending elevational relationship of said bed from said hopper to said discharge end such that the effects of gravity on the movement of said stone-laden earthen material over the top of said bed of spiked rollers can be manipulated.

19. An apparatus for separating stones from earthen material comprising:

a frame;

a bed of spiked rollers rotatably mounted on said frame including a plurality of spiked rollers, each said roller being oriented transversely to a flow of stone-laden earthen material over said rollers and having spikes extending circumferentially therefrom, each pair of adjacent rollers having said spikes in an offset relationship such that said spikes on adjacent rollers pass between the opposing spikes during rotation of said rollers, said rollers being oriented a descending elevational relationship to urge the stone-laden earthen material along a flow path over said rollers toward a discharge end of said frame, said spiked rollers being operable to separate earthen material from said stone-laden earthen material with said separated material passing through interstitial spaces between said spikes, said bed of spiked rollers being divided into a plurality of zones corresponding to different types of said separated material passing through said bed of spiked rollers;

scrapers supported from said frame to engage at least one of said spiked rollers to remove earthen material from between said spikes;

a hopper for receiving quantities of said stone-laden earthen material, said hopper including a conveyor operable to convey said earthen material onto said bed of spiked rollers;

a collector mechanism positioned beneath said bed of spiked rollers to receive each type of said separated material passing through said bed of spiked rollers; and drive means for rotating said conveyor and said rollers, each said roller being mounted for rotation independently and at different speeds of rotation of each other said roller for at least brief periods of interrupted operation.

20. The apparatus of claim 19 wherein said collector mechanism includes a collector conveyor corresponding to each said zone to convey the collected separated material to a location remote from said apparatus.

* * * * *